US006367708B1

(12) United States Patent
Olson

(10) Patent No.: US 6,367,708 B1
(45) Date of Patent: Apr. 9, 2002

(54) POP-UP MICRO-SPRAY NOZZLE

(76) Inventor: Donald O. Olson, 1953 Hacienda Dr., El Cajon, CA (US) 92020

( * ) Notice: Subject to any disclaimer, the term of this patent is extended or adjusted under 35 U.S.C. 154(b) by 0 days.

(21) Appl. No.: 09/313,127

(22) Filed: May 17, 1999

(51) Int. Cl.[7] ..... B05B 1/26; B05B 1/30

(52) U.S. Cl. ..... 239/74; 239/443; 239/465; 239/498; 239/505; 239/518; 239/580; 239/DIG. 1

(58) Field of Search ..... 239/71, 74, 390, 239/396, 436, 443, 444, 498, 504, 505, 518, 520–522, DIG. 1, 580, 465

(56) References Cited

U.S. PATENT DOCUMENTS 3,762,650 A * 10/1973 Radecki ..... 239/396
4,189,099 A * 2/1980 Bruninga ..... 239/580 X
4,220,283 A * 9/1980 Citron ..... 239/518 X
4,625,917 A * 12/1986 Torney ..... 239/444 X
4,739,934 A * 4/1988 Gewelber ..... 239/444 X
5,050,800 A * 9/1991 Lamar ..... 239/444 X

* cited by examiner

*Primary Examiner*—Lesley D. Morris
(74) *Attorney, Agent, or Firm*—J. Mark Holland

(57) ABSTRACT

A sprinkler head apparatus includes two separately molded members secured together independently of a water volume control member. A number of selectively removable devices that withstand the forces of water in irrigation systems and can be easily removed by the user without additional hardware are situated at the entry point of water outflow channels to provide the user directional control of the water sprayed from the apparatus. Registration elements are provided to ensure the proper alignment between the members of the apparatus. Correspondingly, indicia located at upper and lower external surfaces of the assembled apparatus reduce or eliminate the need to disassemble the apparatus or intermittently test the water spray pattern to ensure proper installation of the apparatus. Preferred methods for assembling the apparatus, for directing the outflow of water, and for aligning the members of the apparatus are disclosed.

40 Claims, 4 Drawing Sheets

POP-UP MICRO-SPRAY NOZZLE

This invention relates to sprinkler head assemblies, and specifically to an improved apparatus and method of assembly and use for such assemblies, which provide flexibility, economy, and ease of operation to the user.

BACKGROUND OF THE INVENTION

For cost and other reasons, sprinkler heads are typically constructed from one or more molded plastic pieces. Manufacturing considerations sometimes result in sprinkler heads with two or more plastic members created from relatively simple molds, in contrast to construction of sprinkler heads comprised of a single plastic member from a relatively complex mold. For example, constructing a sprinkler head from a single, complex mold can result in an apparatus with inconsistent structural integrity and other heat characteristics (arising from the heating and cooling of plastic during the molding). Poor structural integrity can result in increased breakage during assembly, packaging, and use; and can thereby decrease the yield of usable products by the manufacturer as well as the user. Although it is known to use two or more relatively simple pieces to fabricate a sprinkler head, numerous shortcomings are still evident in the prior art.

Sprinkler heads have been designed to provide users control of both the volume and direction of water outflow from irrigation systems. Some prior art sprinkler heads contain a water volume control device (typically a threaded device) which also acts to secure the individual members comprising the sprinkler head to one another. Examples include U.S. Pat. No. 4,189,099 (Bruninga); U.S. Pat. No. 4,625,917 (Torney); and 4,739,934 (Gewelber). The use of a single element (such as a threaded device) to both control the volume of water through the sprinkler head and to secure the sprinkler head assembly together can risk damaging the sprinkler head assembly. Among other things, excessive tightening of the water volume adjustment device by the user can inadvertently cause unwanted and excessive stress on that or other sprinkler head components, immediately or eventually causing the plastic sprinkler head to crack and fail or otherwise become unusable.

Some prior art systems (for example, U.S. Pat. No. 4,625,917 (Torney) and U.S. Pat. No. 4,739,934 (Gewelber)) use removable devices (e.g. plugs or tabs) in water outflow channels, to permit an installer or user to control the direction and pattern in which water sprays from the sprinkler head. These flow directing devices are typically designed to withstand the forces of normal household water pressure but can still be selectably removed by the user, as described below. Design considerations in such devices include the number of flow directing tabs or devices, and the relationship between the devices and the water channels in the rest of the sprinkler assembly. Some prior art devices allow the user to selectively adjust the angle in which water sprays from the sprinkler head between 0 and 360 degrees. However, these devices typically are cumbersome and difficult to "set" (e.g., remove the tabs or plugs) in the field, as they require the use of additional tools (e.g. a nail, an awl, or a screwdriver), and/or require disassembly of the sprinkler head, for their removal or adjustment.

The use of additional hardware to "set" (e.g., remove or adjust) these tabs or flow control devices can also present some physical risk to the user. For example, in the commonly wet handling conditions found when using and installing these sprinkler heads, there is an increased likelihood that the foreign instrument used to remove the tab or flow directing devices (a nail for example), may slip and consequently result in injury to the user.

Furthermore, in sprinkler heads comprised of more than one component, disassembly of the sprinkler head (in contrast to simply unscrewing the head assembly from the irrigation pipe riser) is typically required to gain access to these tabs or flow directing devices. This disassembly increases the time required to make any desired flow adjustments, and also increases the risk that some components may be lost during disassembly and reassembly.

Another shortcoming of certain prior art sprinkler head assemblies comprised of multiple components is the relative difficulty in "aiming" the water spray in the desired direction. Specifically, certain multi-part prior art devices and assemblies typically lack means to readily and accurately ensure that the individual members of said assemblies are desirably aligned and positioned (and the waterflow is thereby properly directed) without disassembling the sprinkler head apparatus. Commonly, to even test whether the sprinkler head outflow is correctly aimed, a user must permit the water to flow through the system. If the water outflow pattern is incorrect and/or the incorrect water-channel plugs or tabs have been removed, or are not in proper alignment with the corresponding outflow channels, disassembly and reassembly of the sprinkler head may be required (to adjust the waterflow through the head), followed by the subsequent retesting of the water outflow. This procedure is repeated until such time as the desired spray pattern is obtained. The intermittent and repeated testing of water outflow, and the repeated disassembly and reassembly of the sprinkler head is inefficient both in terms of time and manpower.

OBJECTS AND ADVANTAGES OF THE INVENTION

It is, therefore, an object of my invention to provide an improved sprinkler head apparatus and method of use and assembly of same. The preferred sprinkler head of my invention is characterized by a body assembled from multiple components or members, with attachment means to hold those members assembled to one another independently of controlling water volume flow through the apparatus.

Another object of my invention is the provision of an apparatus of the foregoing character which includes upper and lower components or members, and further includes removable tab members exposed at the lower surface of the lower member of the apparatus. Preferably, the apparatus permits easy removal of the tab members without the need for additional equipment. Subsequent to the initial installation, the preferred flow control tab members can be accessed (and removed as necessary) by simply unscrewing the head assembly from the irrigation pipe riser.

A further object of my invention is the provision of an apparatus of the foregoing character including registration means to facilitate desired alignment between the upper and lower members. Among other things, this preferably permits accurate removal of water direction control members (such as tabs) without the need to disassemble the apparatus (or at least without the need to disassemble the other components from each other).

The preferred embodiment also includes serrations on the apparatus to, among other things, facilitate gripping and manipulation by a user and/or by the person installing the system.

Another object of my invention is the provision of a method to fabricate and assemble members of a sprinkler head assembly of the foregoing character.

A still further object of my invention is the provision of a method of directing irrigation water spray patterns by removing water direction control members from a sprinkler head without additional tools or hardware.

Yet, another object of my invention is the provision of a method of desirably aligning upper and lower members of the sprinkler head assembly of the aforementioned character, to permit predictable water flow through the head. The preferred method and apparatus includes a registration key between the upper and lower members.

Other objects and advantages of my invention will be apparent from the following specification and the accompanying drawings, which are for the purpose of illustration only.

DESCRIPTION OF PREFERRED EMBODIMENTS

Figure 1:
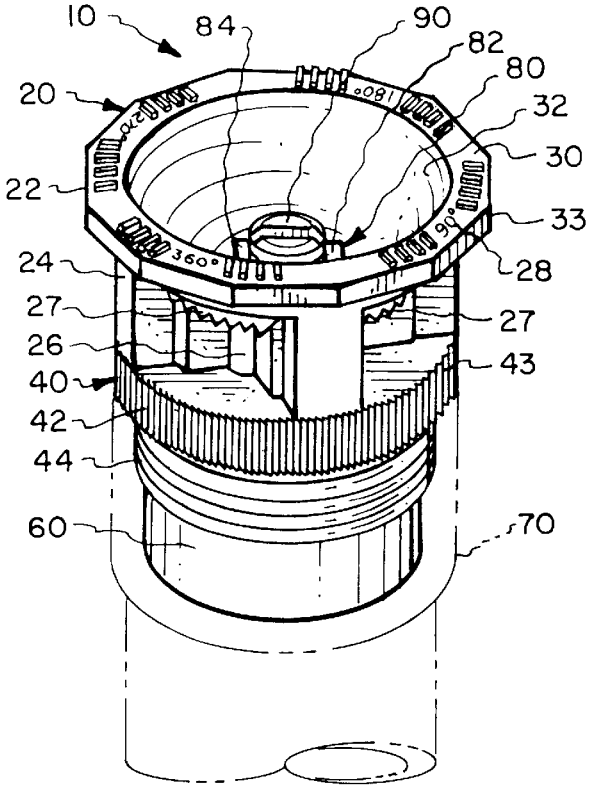
FIG 1. is an isometric view of a preferred embodiment of the sprinkler head assembly of the invention.
Figure 3:
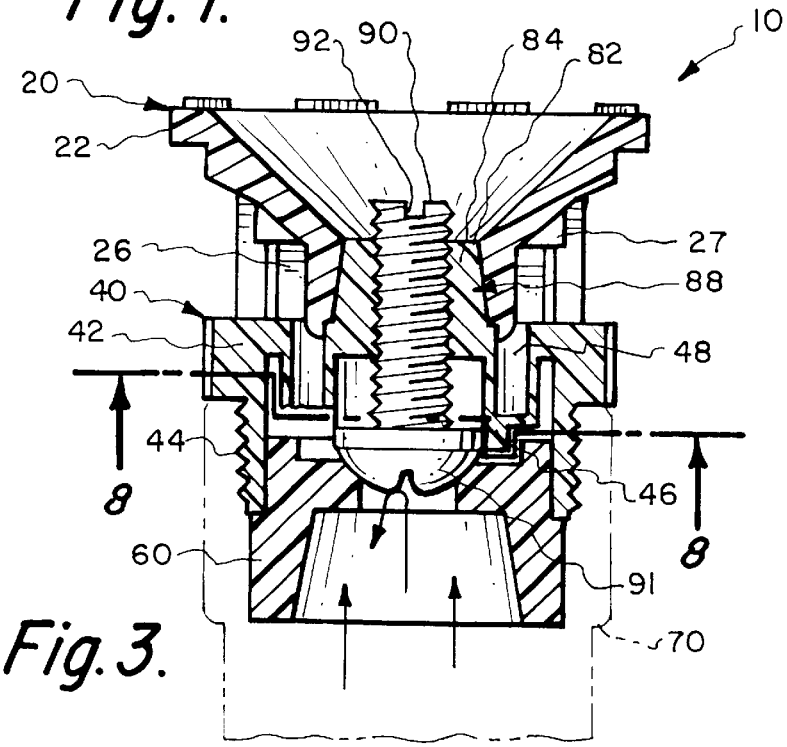
FIG. 3 is a cross-sectional view along line 3—3 of FIG. 2.

Referring to the drawings, and particularly to FIGS. 1 and 3 thereof, I show a preferred embodiment of sprinkler head apparatus 10 assembled in accordance with the teachings of the invention. The irrigation sprayhead apparatus 10 preferably includes upper indicia means 20, such as an upper member 22, which can be mounted onto a lower member 40. The lower member 40 can be readily connected to irrigation piping such as a riser 70, which riser is connected to a water supply source (not shown). Typically, lower member 40 is coupled to piping 70 via thread means 44, although any suitable connection method can be used.

In FIG. 3, element 60 is shown as a filter or similar device, and is preferably situated within and beneath, and is coupled to, lower member 40 by frictional means. Persons of ordinary skill in the art will realize that element 60 is not required to be a filter for the proper functioning of the invention. Instead, as discussed more thoroughly below, its primary function with respect to the invention is in connection with those aspects of the invention that require a seat for blocking water flow through the apparatus 10.

In the preferred embodiment, water enters the sprinkler head 10 from piping 70, through element 60 and lower member 40. As described herein, water is selectably directed out from the sprinkler head 10 through water outlets 26. The volume of water that flows from outlets 26 is controlled by flow volume control means 90, shown in the preferred embodiment as a threaded bolt. Markings or indicia 28 are preferably located on the normally upward surface of upper member 22, and are useful to indicate the angle at which water sprays from sprinkler head 10.

Referring to FIG. 1, and to the preferred embodiment and method of the invention, sprinkler head assembly 10 is preferably molded in separate components (such as upper member 22 and lower member 40) to simplify the molds used for the preferred molding process and thereby improve the quality and repeatability of fabricating those parts. Those parts 22 and 40 are subsequently joined to each other in a relatively permanent manner.

By way of example and not limitation, the preferred embodiment is constructed from plastic molded members, but those of ordinary skill in the art will recognize that the components can be composed of any of a wide range of suitable materials (whose suitability may vary based on economic and other factors). To minimize the material required to fabricate the apparatus and reduce the shipping and handling weight, among other things, upper portion 22 preferably is funnel-shaped (see FIG. 3) with an upper outer rim 30. Inner surface 32 of upper member 22 is preferably downwardly tapered (when the apparatus is finally installed) from outer rim 30 toward the center of upper member 22. Vertically oriented wall members 24 preferably descend from the lower surface of the funnel shape.

Rim 30 preferably includes sufficient area to permit labeling and ready display of markings or indicia 28. The indicia 28 are preferably formed by engraving in the mold or some similar method, and are shown in the preferred embodiment as including four angular numbers (90, 180, 270, and 360). The preferred rim 30 is illustrated with twelve circumferential flat edges, but can alternatively include any number of circumferential edges, or even a smooth (e.g., round) exterior. Among other things, flat external edges enhance gripping of the assembly during installation and/or adjustment.

Although indicia 28 are preferably located on the upper surface of outer rim 30, indicia 28 can be provided at any suitable location of the apparatus 10 which permits easy viewing for orienting the spray direction.

Wall members 24 are preferably attached to lower member 40 as described more fully below, to help define water outlets 26. Persons of ordinary skill in the art will understand that the number of possible spray angles for sprinkler head 10 is determined by those outlets 26. In the preferred embodiment, four wall members 24 and four corresponding water outlets 26 provide possible spray patterns in ninety degree increments. However, persons of ordinary skill in the art will understand that the apparatus can be fabricated with any of a wide range of wall members 24 and water outlets 26, and that those openings 26 can be formed proportionally to one another or not (depending on the desired application and spray pattern for which the particular apparatus may be intended), and thereby provide great flexibility in water spray patterns.

The preferred embodiment of the invention includes spray-diverting ridges 27 in each opening 26, to help disperse the water flow as it exits the apparatus 10. The precise number, shape, and location of these ridges 27 can be selected to effect a wide range of spray patterns.

The preferred embodiment of the invention also includes serrations 33 and 43 along the perimeter gripping surfaces of the apparatus 10. In the preferred embodiment, serrations 33 and 43 are provided as ridges formed on the exterior surface of rim 30 and base 42 by engraving in the mold or other suitable means (see FIGS. 2 and 6 for more detail). Those serrations can be any of a wide range of suitable sizes, shapes, and spacing.

Figure 2:
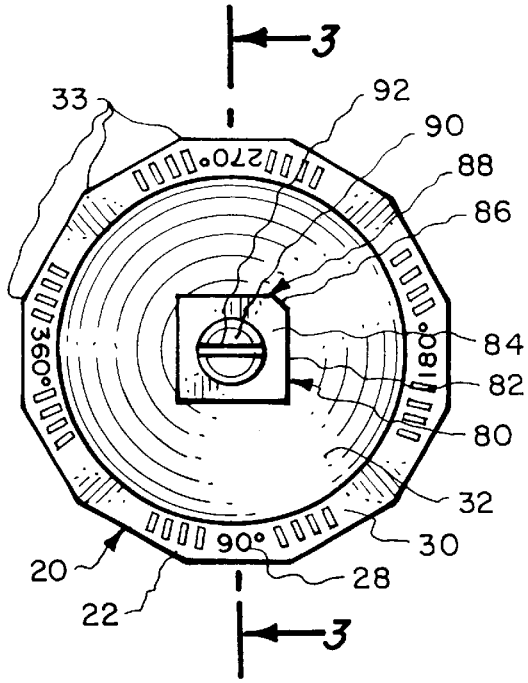
FIG. 2 is a plan view from the top of the apparatus in FIG. 1.

The detail of inner surface 32 of upper member 22 can be more fully viewed in FIG. 2. An inner, central opening 80 of upper member 22, such as female registration means 82, facilitates desired alignment and registration of upper member 22 onto lower member 40, in addition to providing the user/installer with ready access to the water volume control member 90. Persons of ordinary skill in the art will understand that the invention's ready access to the flow adjustment means 90 can be provided even if there is no registration means acting between upper member 22 and lower member 40 (such as, for example, if the male and female fittings between those parts were round, rather than generally square as illustrated in the drawings).

Figure 6:
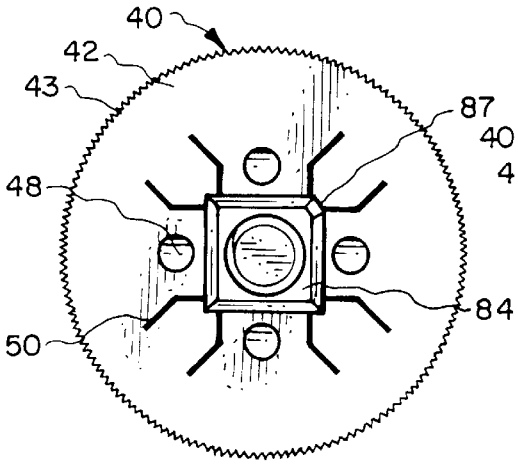
FIG. 6 is similar to FIG. 5, but is a top view of the preferred lower member of the head assembly.

In the preferred embodiment, female registration means 82 includes an opening defined by a four sided perimeter with a single chamfered corner 86. Corresponding male registration means 84 is provided on lower member 40, and is preferably of complementary design to female registration means 82 (so as to provide the registration discussed herein). Specifically, in the preferred embodiment, an angled surface 87 (FIG. 6) on male registration means 84 (shown as a generally square post) ensures proper alignment between upper and lower members 22 and 40 of the sprinkler head. Although the illustrated female registration means 82 is a four-sided shape, registration means can be of any design that ensures the proper alignment between members of the sprinkler head. In the preferred embodiment, male registration means 84 includes an upwardly projecting member 88 formed on the lower member 40. As illustrated in FIGS. 3 and 6, the mating sides of registration means 82 and 84 are preferably tapered to a smaller dimension toward their tops (as they are normally finally positioned).

The preferred embodiment of the invention also includes flow adjustment means 90 within the upwardly projecting member or post 88. The preferred flow volume adjustment means 90 is characterized by a normally exposed topmost surface (again, when the apparatus 10 is in its normal operating position) having control means 92 formed therein. In this embodiment, flow adjustment means 90 is provided as a threaded, adjustable, rust-resistant bolt (formed of aluminum, stainless steel, plastic, or other suitable material), and control means 92 is provided as a recessed straight line formed in the end thereof. The preferred control means 92 facilitates rotational adjustment of the bolt by a screwdriver or other instrument. Persons of ordinary skill in the art will understand, however, that control means 92 can be of any of a wide variety of designs providing the user control of the flow adjustment means 90. Examples of the many alternative embodiments for control means 92 include a grippable detent or tab attached to or formed on the end of flow adjustment means 90 and protruding upwardly therefrom, etc. Persons of ordinary skill in the art will recognize that the economic viability of any particular embodiment will vary, depending on a number of factors.

The preferred nature and design of the assembled sprinkler device 10 and particularly its lower member 40 is further illustrated in FIG. 3. Lower member 40 is preferably a single unit molded from plastic or other similarly strong, lightweight material. In the preferred embodiment, lower member 40 is a generally cylindrical structure including a centrally located, upwardly protruding member 88 formed on a base 42. The base 42 is preferably configured to be operatively coupled to an irrigation pipe or riser 70, such as by thread means 44.

The lower member 40 also preferably includes water outflow channels 48 which open to water outlets 26. Preferably, the channels or openings 48 are positioned between the upwardly protruding member 88 and the outer edge of base 42, and one such opening 48 is provided for each outlet 26.

The preferred embodiment also includes downwardly protruding flow direction control members 46 (illustrated as removable tabs or detents in the preferred embodiment) at the normally lower surface of lower member 40. Preferably, one such control member 46 is provided at the entry-site of each water outflow channel 48. Persons of ordinary skill in the art will understand that removal of any particular control member 46 will permit water to flow through the corresponding passage 48 and out the corresponding spray outlet 26 (assuming that the water volume control means 90 is set to permit water flow through the apparatus).

The water direction control members 46 are preferably designed to withstand normal water pressure ranges found in irrigation systems, while still being selectively removable by the user without the use of additional equipment (such as pliers, a screwdriver, or the like). For each of the aforementioned water outlets 26, there is preferably a corresponding water out-flow channel 48 and water direction control member 46. Persons of ordinary skill in the art will understand, however, that there does not have to be a precise correspondence between the number of frangible water direction control members 46, channels 48, and outlets 26. Also, depending on the application and the end user's needs, the precise number and location of those parts 46, 48, and 26 of the apparatus 10 can range from one to the maximum number of outlets formable from the particular material selected for the components 22 and 40.

Figure 9:
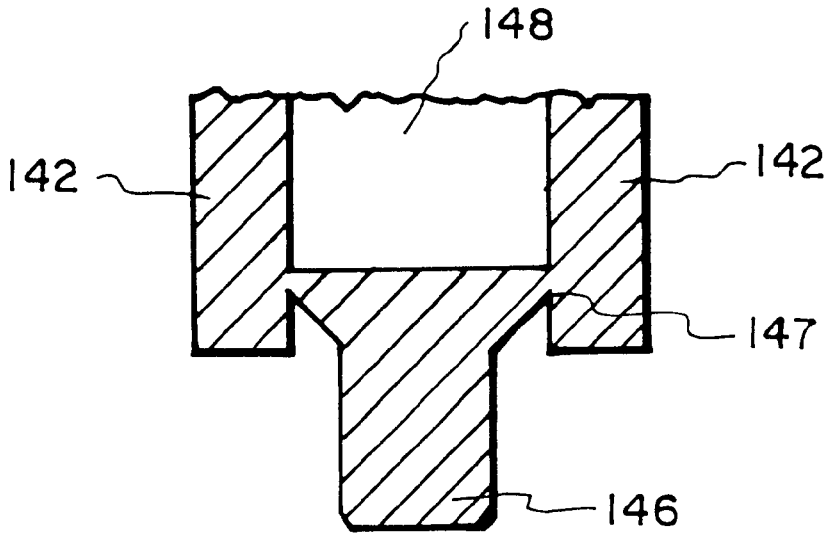
FIG. 9 illustrates one of the many alternative embodiments of the removable tab members of the invention.

Preferably, water direction control members 46 have a cylindrical configuration, but those of ordinary skill in the art will recognize that members 46 can have a variety of shapes (e.g. triangular, rectangular, etc.) to accommodate the various needs of the user. Removal of water direction control members 46 can be accomplished by bending the tab or by pushing the tab until it breaks from its attachment. FIG. 9 depicts one of the many alternative embodiments of water direction control members, and shows a water direction control member 146 with a frangible bridge 147 between control member 146 and the body of base 142.

Those of ordinary skill in the art will understand that FIG. 9 depicts a view of a water control member similar to that shown in FIG. 3, in which the water channel 48 (in FIG. 3) is analogous to a similar water channel 148, and the control member 146 is disposed within that water channel 148. Persons of ordinary skill in the art will further understand that the particular location of the control member 146 with respect to water channel 148 is not critical, so long as it functions to prevent water flow through water channel 148 prior to removal or breakage of control member 146 from the body of base 142, and permits water flow thereafter.

Frangible bridge 147 preferably constitutes a "tear line" situated along the perimeter of water direction control member 146, which "tear line" facilitates the aforementioned breakage of detent 146 from the body of base 142. Persons of ordinary skill in the art will further understand that, in view of the preferably relatively smaller water flow constriction at some point in water outlet 26 (FIGS. 1 and 3) (as compared to the cross-sectional opening of water channel 148), complete removal of water direction control member 146 is not necessary to obtain the desired flow of water from sprinkler head 10. In other words, so long as detent 146 is "broken" or removed enough to provide at least as much water flow cross-sectional opening into water channel 148 as exists downstream from there (e.g., in the narrowest bottleneck along water outlet 26), the detent 146 will not limit the water flow through the sprinkler head 10.

FIG. 3 also depicts the structure of, and relationship between, flow adjustment means 90 and lower member 40. Flow adjustment means 90, in this preferred embodiment, includes a member (e.g. a bolt or screw) threadedly engaged with the lower member 40. Persons of ordinary skill in the art will understand that rotational adjustment of the bolt 90 by way of control means 92 moves its head 91 vertically. The position of the head 91 determines the amount of water flow through the sprinkler head. If the head 91 is seated against element 60, no water flows through the apparatus 10. As the head 91 is displaced from that element 60, flow increases (assuming that one or more tab members 46 have been removed to permit flow through the apparatus 10.

Persons of ordinary skill in the art will understand, however, that the flow adjustment means in this preferred embodiment of the invention can include any of a wide range of devices and structures whose function is to regulate the flow of water independent of securing together upper and lower members of the sprinkler head. Specifically, as illustrated in FIG. 3, flow adjustment means 90 has been fully tightened in such a manner as to completely block water flow through sprinkler head 10 (see the curved arrow in the bottom center of FIG. 3). Water flow is similarly blocked in FIG. 7 (by both the bolt head and the fact that no tab members 46 have been removed), but flow is permitted in FIG. 4, which illustrates the bolt 90 spaced from element 60 (and not in seated engagement therewith).

Figure 4:
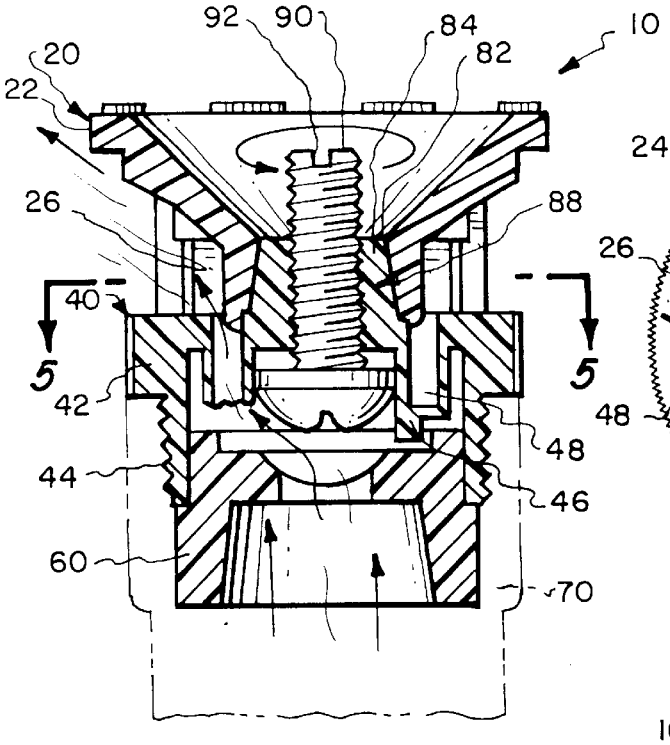
FIG. 4 is similar to FIG. 3, and illustrates, among other things, the adjustment of water volume control member, the removal of a selected water direction control device, and the corresponding flow of water through the assembly.

FIG. 4 illustrates some of the principles of operation of the sprinkler head 10, and particularly water direction control members 46. In FIG. 4, one water direction control member 46 on the left half of sprinkler head assembly 10 has been removed, and flow control member 90 has been rotationally adjusted to space it from element 60. This adjustment permits the flow of water from pipe 70 through a central opening in element 60, through water channel 48 and out water outlet 26. In this figure, water direction control member 46 on the right half of sprinkler head apparatus 10 remains intact, and consequently prevents outflow of water through the respective "right-hand" channel and outlet. This illustration demonstrates how the selectably removable detents can be utilized to specify the channels for water outflow and relatedly the spray pattern from the sprinkler head.

Figure 5:
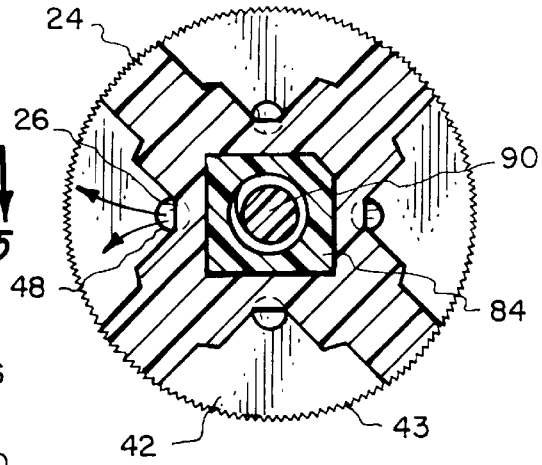
FIG. 5 is a cross-sectional view along line 5—5 of FIG. 4.

In FIG. 5, water channels 48 are seen situated within base 42 of the lower member 40. Water flows from the leftmost water channel 48 due to the selective removal of the corresponding flow direction control means 46, as discussed above. The resulting arc of the water sprayed from opening 26 is determined by a number of factors, including the position and configuration of walls 24. In the preferred embodiment, walls 24 define four arcs of approximately ninety-degrees each. Persons of ordinary skill in the art will understand that changing the number of walls 24, water outlets 26, and water channels 48 (by modifying the injection mold for parts 22 and 40, for example) can affect the arc size in which water is sprayed from an individual outlet 26, and can provide increased possibilities in spray patterns.

FIG. 6 illustrates the top view of the preferred embodiment of lower portion 40 (similar to FIG. 5 prior to the fixation of upper portion 22 to lower portion 40). Among other things, this view indicates the preferred sites of attachment 50 of upper member 22 to lower member 40. Preferably, attachment sites 50 are tiny ridges used to ultrasonically weld the parts 22 and 40 to each other. Persons of ordinary skill in the art will understand that the ridges 50 may be provided in any suitable pattern, that the welds are formed along those ridges, and that once welding is completed, the ridges effectively "disappear" and the material that formed those ridges is incorporated into the welds. Although attachment sites 50 are designed for use with ultrasonic welding means, those of ordinary skill in the art will recognize that any appropriate means of fixed attachment could be utilized to secure upper portion 22 to lower portion 40, including gluing, heat-staking, mechanical interlocks, etc. Those of ordinary skill in the art will also understand that in this preferred embodiment, the preferred means of fixed attachment act to permanently attach upper portion 22 to lower portion 40.

Figure 10:
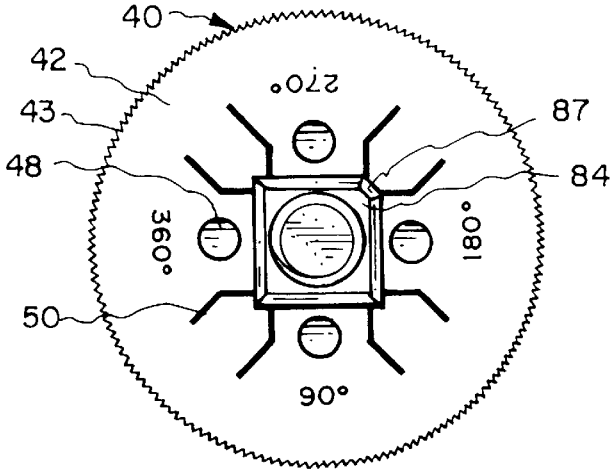
FIG. 10 is similar to FIG. 6 but illustrates an alternative embodiment of the invention in which directional indicia are provided on lower member 40 of the apparatus of the invention.

In addition, an alternative embodiment of the invention, illustrated in FIG. 10, includes directional indicia (shown as engraved markings 90°, 180°, 270°, and 360°) on the surface of lower portion 40. Persons of ordinary skill in the art will understand that these indicia may be any suitable numbers or letters (or other symbols). Convenient alternatives include the set of numbers 0, 90, 180, and 270, corresponding to angles similarly to the illustrated 90, 180, 270, and 360.

Persons of ordinary skill in the art will also understand that, among other things, the preferred assembly already displays such indicia on the normally upper and lower surfaces of the entire assembly (as discussed elsewhere herein), and the upper portion 22 is keyed to lower portion 40 so that the additional indicia shown in FIG. 10 are not "necessary" for many applications. Certain other applications, however, may benefit from the addition of the FIG. 10 indicia. By way of example, it may be useful to break-out certain of the water direction control members 46 prior to assembly of upper portion 22 with lower portion 40, and it may be easier to do so from the "top" side of lower portion 40. In such instances, the indicia of FIG. 10 would make it easier to select the desired water direction control member 46, as compared to having to turn over the lower portion 40 to make that determination.

Another of the several examples in which FIG. 10's "additional" indicia might be useful is to better ensure the visibility of directional indicia from the "upper" side of the assembly. By providing both the FIG. 10 indicia and "upper" indicia 28 (see FIG. 1), installers or other users might be better able to see one or the other of the two sets of indicia. If the "upper" indicia 28 became damaged (from mowing or the like) or covered with mud or dirt, the FIG. 10 indicia might remain visible and usable (by virtue of their preferably more protected position within the assembly and the water flow adjacent the FIG. 10 indicia).

Persons of ordinary skill in the art will also understand that the "upper" indicia 28 (see FIG. 1) could be omitted, and the indicia of FIG. 10 provided instead (for the uses and benefits discussed herein regarding indicia 28).

Figure 11:
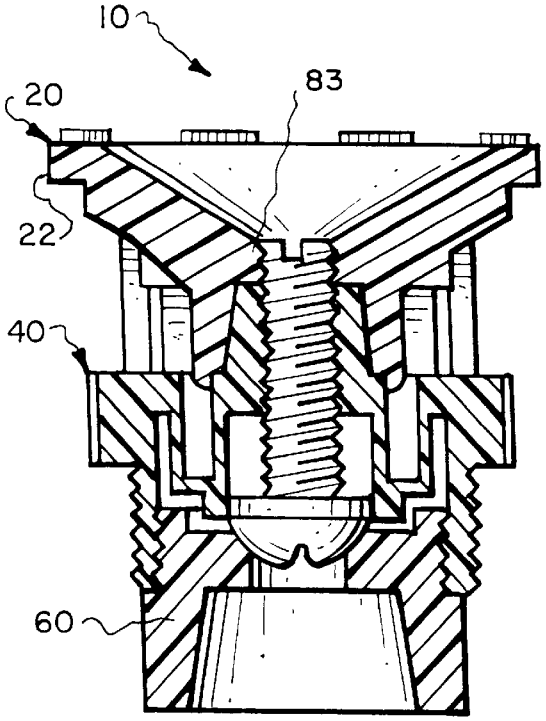
FIG. 11 is similar to FIG. 3 but illustrates an alternative embodiment of the invention in which internal portion 83 of upper member 22 possesses threads to engage with the threaded portion of the flow adjusting screw 90.
Figure 12:
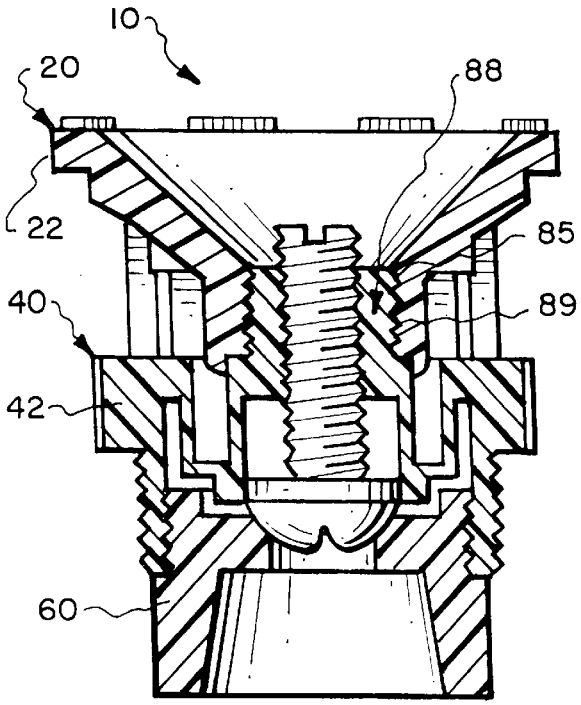
FIG. 12 illustrates yet another of the many alternative embodiments of the invention in which threaded internal portion 85 of upper member 22 is configured to engage with externally threaded portion 89 of upwardly protruding member 88.

Additionally, persons of ordinary skill in the art will understand that certain other aspects of the invention may be practiced in alternative embodiments (FIGS. 11 and 12) which include a threaded internal portion 83 formed in upper member 22 (FIG. 11), sized and configured to engage the threaded portion of the flow adjusting screw 90. In such embodiments, the screw 90 would preferably engage not only the lower portion 40 (such as is illustrated in FIG. 3, for example), but would also engage the aforementioned additional threaded portion 83 in upper portion 22. As another alternative, illustrated in FIG. 12, a threaded internal portion 85 formed in upper member 22 can be sized and configured to engage an externally threaded portion 89 of upwardly protruding member 88 of base 42. In such an embodiment, the desirable registration of the upper and lower portions could be accomplished by a number of alternative methods such as by coordinating the timing of the threads between the upper member 22 and the upwardly protruding member 88, for example (alternatively, even if no such registration was provided, other beneficial aspects of the invention could still be practiced). Such threaded engagement (as illustrated in FIG. 12) could serve to securely attach upper portion 22 to lower portion 40 whereby the secured attachment constitutes a preferably tight, non-permanent connection between the upper and lower portions of the sprinkler head.

Figure 7:
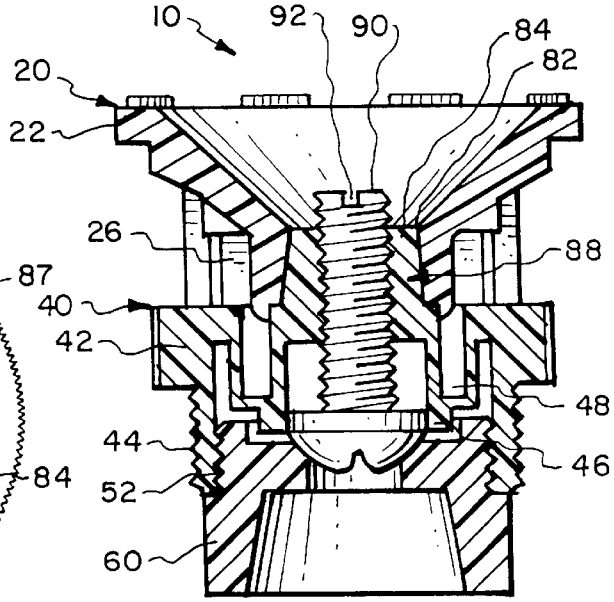
FIG. 7 is similar to FIG. 3, but illustrates one of the many alternative embodiments of the sprinkler head assembly of the invention.

Another of the many alternative embodiments of the invention is illustrated in FIG. 7. In this embodiment, flow adjustment means 90 is indicated in the fully closed position and all removable water direction control members 46 are left intact. To permit flow through the apparatus, at least one water direction control member 46 would have to be removed and the flow adjustment means 90 opened at least slightly. This embodiment of the invention illustrates another means of securing sprinkler head assembly 10 to element 60. In this embodiment of FIG. 7, lower member 40 has internal threaded means 52, in addition to external threaded means 44, to couple element 60 to lower member 40.

Figure 8:
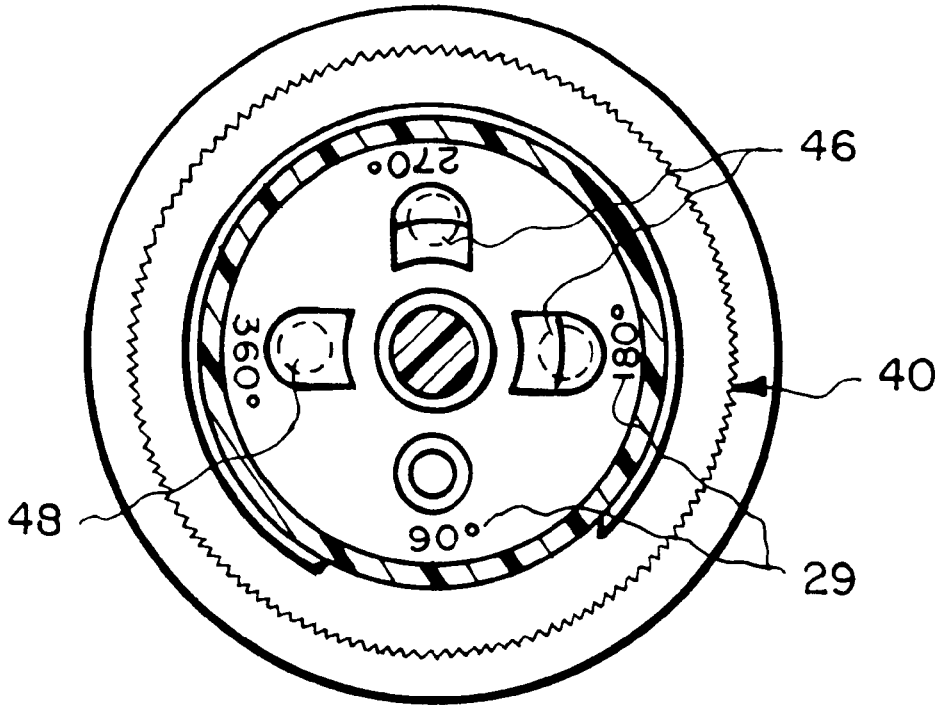
FIG. 8 is a bottom view of the preferred lower member 40 of the apparatus of the invention, taken along line 8—8 of FIG. 3.

FIG. 8 illustrates a preferred bottom view of the lower member 40. Persons of ordinary skill in the art will understand that indicia 29 (preferably corresponding to the markings 28 on the upper surface of rim 30) can be engraved or otherwise provided on the lower, viewable surface shown in FIG. 8. By correlating the aforementioned registration means 82 and 84 with the indicia engraving 28 and 29, the proper assembly between parts 22 and 40 is ensured. Specifically, the registration means 82 and 84 ensure that corresponding indicia (e.g., "90" and "90" will be aligned with each other) because the chamfered corner 86 (FIG. 2) will only permit assembly in one orientation. Once assembled, the two parts 22 and 40 can be ultrasonically welded together or otherwise joined to each other, and an installer can reliably break off one or more tabs to "open" the desired range of spray arc from the head 10. For example, if the user/installer wants only a 90-degree arc, he or she can break offjust the tab adjacent the "90" indicia 29. The installer then turns over the apparatus 10 and assembles it onto the riser 70, using the upper indicia 28 to reliably aim the 90-degree arc (he or she simply points the "90" indicia opening in the desired direction).

Similarly, if a 180-degree arc is desired, the user breaks off both the "90" and "180" tabs 46 from the bottom member 40, and "aims" the "90" and "180" arcs on the upper indicia 28 in the desired direction. Similar approaches can be utilized for 270 degree sprays, or for whatever range the apparatus 10 is fabricated and "set" (by breaking off various tabs 46).

Those of ordinary skill in the art will understand that the indicia 29 on the lower side of member 22 are not absolutely necessary to the apparatus, because a user or installer can look at the upper indicia 28, track the desired spray port while turning over the assembled apparatus 10, and then locate and break off the corresponding tab 46. Inclusion of the lower indicia 29 makes the operation much simpler and more straightforward.

Likewise, persons of ordinary skill in the art will understand that a user/installer does not have to break off the "lowest-numbered" tab 46 first, but that if the user/installer develops that habit, it will be easy to remember which spray ports are the "active" ones when orienting the assembly 10 on the riser 70.

Because the spray head 10 is typically always going to have at least one flow path for water, the spray head 10 can be fabricated so that one of the tabs 46 is not formed; that is, so that one channel 48 is already "open" for flow as soon as the part is manufactured. Thus, in the preferred embodiment described herein, the "90degree" flow path could be fabricated without a tab 46 blocking the flow, resulting in a part such as illustrated in FIG. 8. If a wider arc of spray is desired, one or more of the other tabs 46 can be removed at the time of installation of the head assembly 10 onto the riser 70.

A related preferred method of assembling an irrigation sprinkler system includes various combinations of the following steps: (a) providing a spray head lower member 40 containing a water volume control means 90 for adjustably setting the flow volume through the spray head; (b) providing an upper member 22 to be attached to a lower member; and (c) assembling the upper and lower members 22 and 40 to each other so that the water volume control means is not directly attached to the upper member. The method can also include the step of attaching the upper and lower members 22 and 40 to each other by ultrasonic welding.

Another preferred method of the invention includes directing the outflow of water from an irrigation sprinkler head and includes the steps of: (a) identifying the desired water outflow pattern; (b) providing a two-part spray head assembly 10 having removable tabs 46 associated with the normally lower of those two parts, in which removal of one or more tabs correspondingly directs flow through the head assembly 10 after engagement of the head assembly with an irrigation riser member 70, the head assembly having corresponding indicia on each of the two parts. Preferably, the indicia on the normally lower of the two parts is viewable prior to engagement of the head assembly 10 with the irrigation riser member 70 and the indicia on the normally upper of the two parts is viewable thereafter. Further steps include (c) selecting at least one of the tabs to accomplish the desired water outflow pattern; (d) removing the selected tab without disassembly of the two parts; and (e) affixing the head assembly 10 to the irrigation riser member 70 and using the indicia on the normally upper of the two parts to orient the head assembly to accomplish the desired flow pattern. The method can also include the step of removing the selected tab by hand and without the use of separate tools or equipment.

Yet another preferred method of the invention is directed to aligning an upper and lower member of a sprinkler head assembly with each other to facilitate subsequent assembly of the head with irrigation tubing. It preferably includes the steps of: (a) providing a registration key at an upper external surface of a lower member of the sprinkler head assembly 10; (b) providing a mating registration key at a lower external surface of an upper member of the sprinkler head assembly 10; and (c) providing indicia on both of the upper and lower members, viewable on each of the members when the members are fixedly registered with each other, the indicia correlating to chamfered corners of the upper and lower members and thereby to each other. The method can also include the step of providing registration keys that constitute mating surfaces formed as a single mating chamfered corner in the assembly 10.

Thus, by my invention I provide an apparatus and a method for assembling and using a sprinkler head that provide numerous advantages, including saving the user time and money, as compared to the prior art. For example, the preferred components of the sprinkler head are quickly assembled in proper fashion by way of registration means that permit fitting of the upper and lower portions of the sprinkler head body in only one possible arrangement. In the preferred embodiment, the desired water spray pattern is easily obtained by the selective removal of the desired tabs from the assembled sprinkler head without additional tools. The correct orientation of the installed sprinkler head is accurately and quickly verified by indicia on the upper surface of the sprinkler head corresponding to indicia of the removed tabs. This eliminates (or at least reduces) the need to repeatedly test the spray pattern and disassemble the sprinkler head to correct the spray pattern. The volume control means can be adjusted without concern of damaging the sprinkler head due to the attachment of the upper and lower sprinkler head members together independently of the preferred water volume control mechanisms.

The apparatus and methods of my invention have been described with some particularity, but the specific designs, constructions and steps disclosed are not to be taken as delimiting of the invention in that various obvious modifications will make themselves apparent to those of ordinary skill in the art, all of which will not depart from the essence of the invention and all such changes and modifications are intended to be encompassed within the appended claims.

I claim:

1. Apparatus for use with irrigation systems, including a body having an upper portion fixedly attached to a lower portion, flow volume control means engaged with said lower portion, at least one selectably frangibly removable flow direction control member formed on a lower external surface of said lower member, and registration means between said upper and lower portions, to facilitate desired alignment between said upper and lower portions prior to said fixed attachment therebetween.

2. The apparatus of claim 1, in which outer edges of said upper and lower portions are serrated.

3. The apparatus of claim 2, in which said selectably removable direction control members include a protruding portion permitting separation by hand of said portion from said lower portion of said body.

4. The apparatus of claim 1, in which said selectably removable direction control members include a protruding portion permitting separation by hand of said portion from said lower portion of said body.

5. The apparatus of claim 1 or claim 2 or claim 4 or claim 3, in which said registration means includes indicia located adjacent said selectably removable direction control members and adjacent corresponding locations on an exterior surface of said upper portion.

6. The apparatus of claim 1, in which said flow volume control means is configured to non-destructively disengage said upper from said lower portion when overtightened.

7. Irrigation sprayhead apparatus, including an upper member fixedly attached to a lower member, a water volume control member directly interengaged solely with said lower member and not directly interengaged with said upper member, said lower member includes at least one direction control member integrally formed with said lower member and selectively removable therefrom.

8. The apparatus of claim 7, in which the outer edges of said upper and lower members are serrated.

9. The apparatus of claim 8, in which said separable control members include at least one extending portion grippable by a user's hand, and removable thereby.

10. The apparatus of claim 7, in which said separable control members include at least one extending portion grippable by a user's hand, and removable thereby.

11. The apparatus of claim 7 or claim 8 or claim 10 or claim 9, further including corresponding indicia on each of said upper and lower members, said indicia being visible on both of said upper and lower members prior to assembly of said apparatus with other portions of an irrigation systems in which said apparatus is used, and corresponding elements on each of said upper and lower members to permit registration of said upper and lower members with each other prior to said fixed attachment therebetween so that said indicia on said respective upper and lower members are operably aligned with each other.

12. Apparatus for use with water delivery systems, including a first portion separately molded from a second portion, said portions being fixedly attached to each other, and frangible water flow direction control members situated at the lower external surface of said lower member to selectively direct water flow through said apparatus.

13. The apparatus of claim 12, in which outer edges of said upper and lower members are serrated.

14. The apparatus of claim 12, in which said frangible water direction control members constitute a detent grippable by a user's hand to permit removal of same without additional equipment.

15. The apparatus of claim 13, in which said frangible water direction control members constitute a detent grippable by a user's hand to permit removal of same without additional equipment.

16. The apparatus of claim or claim 12 or claim 13 or claim 14 or claim 15, further including registration means acting between a peripheral surface of said lower member and a non-peripheral surface of said upper member, to ensure desired alignment between said upper and lower members.

17. The apparatus of claim 16, in which said registration means include mating correspondingly angled surfaces on said upper and lower members.

18. The apparatus of claim 17, including spray directional markings adjacent said frangible water direction control members and adjacent corresponding locations on an upper surface of said upper member.

19. Apparatus for use with water delivery systems, including a first portion separately molded from a second portion, said portions being securely attached to each other, and at least one frangible water flow direction control member situated at the lower external surface of said lower member to selectively direct water flow through said apparatus.

20. The apparatus of claim 19, whereby said secured attachment is provided by the cooperative engagement of a water volume control means with said upper and lower members.

21. The apparatus of claim 20, in which outer edges of said upper and lower portions are serrated.

22. The apparatus of claim 21, in which said frangible water direction control member constitutes a detent grippable by a user's hand to permit removal of same without additional equipment.

23. The apparatus of claim 19, in which outer edges of said upper and lower portions are serrated.

24. The apparatus of claim 23, in which said frangible water direction control member constitutes a detent grippable by a user's hand to permit removal of same without additional equipment.

25. The apparatus of claim 19, in which said frangible water direction control member constitutes a detent grippable by a user's hand to permit removal of same without additional equipment.

26. The apparatus of claim 20, in which said frangible water direction control member constitutes a detent grippable by a user's hand to permit removal of same without additional equipment.

27. The apparatus of claim 19 or claim 20 or claim 23 or claim 21 or claim 25 or claim 26 or claim 24 or claim 22 further including registration means acting between said lower member and said upper member, to ensure desired alignment between said upper and lower members.

28. The apparatus of claim 27, in which said registration means include mating correspondingly angled surfaces on said upper and lower members.

29. The apparatus of claim 28, including spray directional markings adjacent said frangible water direction control members and adjacent corresponding locations on an upper surface of said upper member.

30. The apparatus of claim 12 or claim 19, including a flow volume control means that is non-destructive to either the first portion or the second portion when said flow volume control means is overtightened.

31. Apparatus for use with water delivery systems, including an upper member, a lower member, attachment means to enable secured attachment of said upper and lower members, said lower member includes at least one direction control member integrally formed with said lower member and selectively removable therefrom, and registration means between adjoining surfaces of said upper and lower members to ensure alignment between corresponding directional indicia formed separately on said upper and lower members.

32. The apparatus of claim 31, whereby said secured attachment is obtained by the cooperative engagement of a water volume control means with said upper and lower members.

33. A method of assembling an irrigation sprinkler system, including the steps of:

(a) providing a spray head lower member containing water volume control means for adjustably setting the flow volume through said spray head;

(b) providing an upper member to be attached to said lower member;

(c) assembling said upper and lower members to each other so that said water volume control means is not directly attached to said upper member; and (d) setting water coverage by selectably removing a direction control member, said lower member including at least one direction control member integrally formed with said lower member and selectively removable therefrom.

34. The method of claim 33, including the step of attaching said upper and lower members to each other by ultrasonic welding.

35. A method of directing the outflow of water from an irrigation sprinkler head, including the steps of:

(a) identifying the desired water outflow pattern;

(b) providing a two-part spray head assembly having frangibly removable tabs associated with the normally lower of said two parts, in which removal of one or more tabs correspondingly directs flow through said head assembly after engagement of said head assembly with an irrigation riser member, said head assembly having corresponding indicia on each of said two parts, said indicia on said normally lower of said two parts being viewable prior to engagement of said head assembly with the irrigation riser member and said indicia on said normally upper of said two parts being viewable thereafter;

(c) selecting at least one of said tabs to accomplish said desired water outflow pattern;

(d) removing said selected tab without disassembly of said two parts; and (e) affixing said head assembly to the irrigation riser member and using said indicia on said normally upper of said two parts to orient said head assembly to accomplish the desired flow pattern.

36. The method of claim 35, in which said removing step is accomplished by hand and without the use of separate tools or equipment.

37. The method of claim 35, further including the step of adjusting a volume control member that is non-destructive to said two-part spray head assembly when said volume control member is overtightened.

38. A method of aligning an upper and lower member of a sprinkler head assembly with each other to facilitate subsequent assembly of the head with irrigation tubing, including the steps of:

(a) providing a registration key at an upper external surface of a lower member of the sprinkler head assembly;

(b) providing a mating registration key at a lower external surface of an upper member of the sprinkler head assembly;

(c) providing indicia on both of said upper and lower members, viewable on each of said members when said members are fixedly registered with each other; and (d) providing on said lower member at least one direction control member integrally formed with said lower member and selectively removable therefrom.

39. The method of claim 38, in which said registration keys constitute mating surfaces formed as a single mating chamfered corner.

40. Apparatus for use with water delivery systems, including a first portion separate from a second portion, said portions being frictionally fitted to each other, said second portion having an opening to permit water flow therethrough toward said first portion, and a regulator member threadedly engaged with said first portion by rotation about said threads, said regulator member being selectably seatable against said opening in said second portion to block said water flow therethrough, said frictional engagement between said first and second portions permitting said first and second portions to non-catastrophically disengage from each other if said threaded regulator is overtightened against said second portion.

* * * * *